US009125468B2

(12) United States Patent
Pays et al.

(10) Patent No.: US 9,125,468 B2
(45) Date of Patent: Sep. 8, 2015

(54) DEVICE FOR THE APPLICATION OF FIBERS TO HUMAN KERATINOUS FIBERS

(75) Inventors: Karl Pays, Tokyo (JP); Claudia Barba, Paris (FR); Henri Samain, Bievres (FR)

(73) Assignee: L'OREAL, Paris (FR)

( * ) Notice: Subject to any disclaimer, the term of this patent is extended or adjusted under 35 U.S.C. 154(b) by 10 days.

(21) Appl. No.: 13/638,235

(22) PCT Filed: Mar. 25, 2011

(86) PCT No.: PCT/IB2011/051279

§ 371 (c)(1),
(2), (4) Date: Mar. 8, 2013

(87) PCT Pub. No.: WO2011/121510

PCT Pub. Date: Oct. 6, 2011

(65) Prior Publication Data

US 2013/0152960 A1 Jun. 20, 2013

Related U.S. Application Data

(60) Provisional application No. 61/326,669, filed on Apr. 22, 2010, provisional application No. 61/423,818, filed on Dec. 16, 2010.

(30) Foreign Application Priority Data

Mar. 29, 2010 (FR) ..... 10 52300
May 11, 2010 (FR) ..... 10 53681

(51) Int. Cl.

| | |
|---|---|
| ***A45D 8/00*** | (2006.01) |
| ***A41G 5/02*** | (2006.01) |
| ***A45D 44/00*** | (2006.01) |

(52) U.S. Cl.
CPC .. *A45D 8/00* (2013.01); *A41G 5/02* (2013.01); *A45D 44/00* (2013.01); *A45D 2200/155* (2013.01)

(58) Field of Classification Search
CPC ..... A41G 5/00; A41G 5/02
USPC ..... 132/216, 217, 53; 424/70.7, 70.12, 424/70.11; 156/327, 326
See application file for complete search history.

(56) References Cited

U.S. PATENT DOCUMENTS 7,803,877 B2 9/2010 Lion et al.
7,875,265 B2 1/2011 Blin et al.

(Continued)

FOREIGN PATENT DOCUMENTS

DE 100 23 990 A1 12/2001
EP 1411069 A2 4/2004

(Continued)

OTHER PUBLICATIONS

Handbook of Pressure Sensitive Adhesive Technology, edited by Donatas Satas, 3rd edition, 1989, pp. 609-619.

(Continued)

*Primary Examiner* — Rachel Steitz
(74) *Attorney, Agent, or Firm* — Jones Robb, PLLC

(57) ABSTRACT

The present invention relates to an element (20) for the application of fibers (F) on human keratinous fibers, comprising fibers (F) held together in a predefined way by a liquefiable adhesive in the solid form, the liquefying of the adhesive on application making it possible for at least a portion of the fibers to separate from the element.

18 Claims, 5 Drawing Sheets

(56) References Cited

U.S. PATENT DOCUMENTS

| | | | | |
|---|---|---|---|---|
| 7,915,347 | B2 | 3/2011 | Lion et al. | |
| 7,932,324 | B2 | 4/2011 | Lion et al. | |
| 7,938,128 | B2 | 5/2011 | Gueret | |
| 2004/0120906 | A1 | 6/2004 | Toumi et al. | |
| 2004/0120920 | A1 | 6/2004 | Lion et al. | |
| 2006/0088484 | A1 | 4/2006 | Thevenet | |
| 2006/0093568 | A1 | 5/2006 | Blin et al. | |
| 2006/0099164 | A1 | 5/2006 | De La Poterie et al. | |
| 2006/0115444 | A1 | 6/2006 | Blin et al. | |
| 2006/0127334 | A1 | 6/2006 | Ferrari et al. | |
| 2006/0134032 | A1 | 6/2006 | Ilekti et al. | |
| 2006/0134044 | A1 | 6/2006 | Blin et al. | |
| 2006/0134051 | A1 | 6/2006 | Blin et al. | |
| 2006/0147402 | A1 | 7/2006 | Blin et al. | |
| 2006/0147403 | A1 | 7/2006 | Ferrari et al. | |
| 2006/0229411 | A1* | 10/2006 | Hatfield et al. | 525/88 |
| 2007/0227550 | A1 | 10/2007 | Merszei | |
| 2007/0286831 | A1 | 12/2007 | Kamada et al. | |
| 2008/0014158 | A1 | 1/2008 | Lion et al. | |
| 2008/0014234 | A1 | 1/2008 | Lion et al. | |
| 2008/0014235 | A1 | 1/2008 | Lion et al. | |
| 2008/0044443 | A1 | 2/2008 | Thevenet | |
| 2008/0050324 | A1 | 2/2008 | Thevenet | |
| 2008/0105272 | A1 | 5/2008 | Thevenet | |
| 2008/0127990 | A1 | 6/2008 | Thevenet | |
| 2009/0020133 | A1 | 1/2009 | Gueret | |
| 2009/0120577 | A1* | 5/2009 | Eichler-Johnson et al. | 156/334 |
| 2009/0217938 | A1* | 9/2009 | Rabe et al. | 132/216 |
| 2009/0217939 | A1 | 9/2009 | Rabe et al. | |
| 2010/0021406 | A1 | 1/2010 | Raineau et al. | |
| 2010/0043816 | A1 | 2/2010 | Dix | |
| 2010/0086507 | A1 | 4/2010 | Gueret | |

FOREIGN PATENT DOCUMENTS

| | | | |
|---|---|---|---|
| EP | 1621101 | A1 | 2/2006 |
| EP | 1955610 | A2 | 8/2008 |
| FR | 1552376 | | 1/1968 |
| FR | 2792190 | A1 | 10/2000 |
| FR | 2905068 | A1 | 2/2008 |
| JP | 2010-024579 | A | 4/2010 |
| WO | 2004028488 | A2 | 4/2004 |
| WO | 2004028493 | A2 | 4/2004 |
| WO | 2005060776 | A2 | 7/2005 |
| WO | 2006037904 | A1 | 4/2006 |
| WO | 2006043544 | A1 | 4/2006 |
| WO | 2009013691 | A2 | 1/2009 |
| WO | 2009052359 | A2 | 4/2009 |
| WO | 2009052360 | A1 | 4/2009 |
| WO | 2009067396 | A1 | 5/2009 |
| WO | 2009126027 | A1 | 10/2009 |

OTHER PUBLICATIONS

French Search Report and Written Opinion for FR1052300, dated Jan. 10, 2011 (9 pages).

French Search Report and Written Opinion for FR1053681, dated Mar. 15, 2011 (6 pages).

International Search Report and Written Opinion for PCT/IB2011/051279, dated Oct. 4, 2011 (13 pages).

Machine English language translation of abstract of DE10023990.

Machine English language translation of abstract of FR1552376.

English language abstract of FR2792190.

English language abstract of JP2010024579.

English language abstract of EP1411069A2.

English language abstract of EP1955610A2.

English language abstract of FR 2905068A1.

English language abstract of WO 2004028488.

English language abstract of WO 2004028493.

English language abstract of WO 2006037904.

English language abstract of WO 2006043544.

* cited by examiner

Fig.8
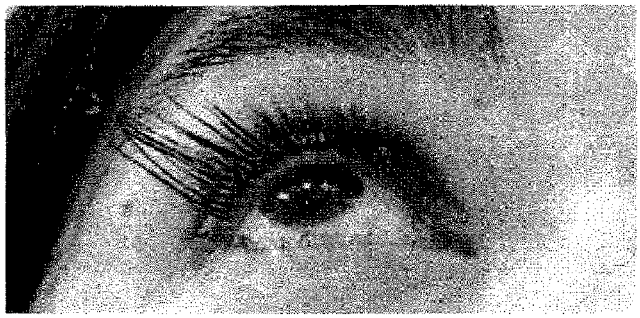
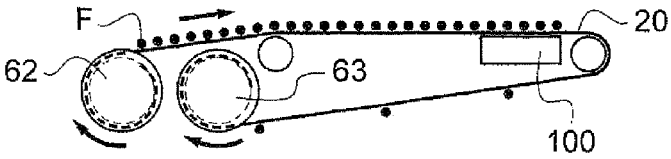
Fig.9
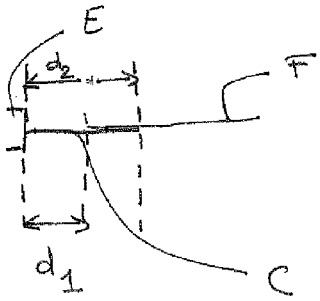
Fig. 11
Fig.10
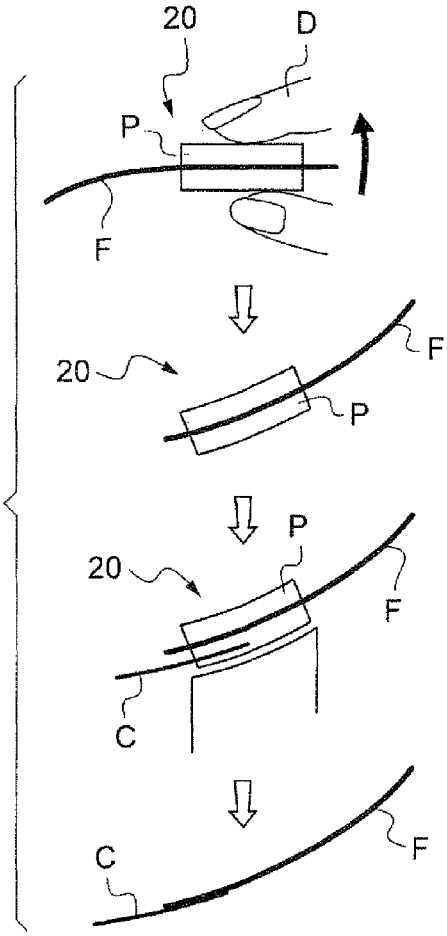

DEVICE FOR THE APPLICATION OF FIBERS TO HUMAN KERATINOUS FIBERS

This is a national stage application of PCT/IB2011/051279, filed internationally on Mar. 25, 2011, which claims priority to French Application No. 1052300, filed on Mar. 29, 2010; U.S. Provisional Application No. 61/326,669, filed on Apr. 22, 2010; French Application No. 1053681, filed on May 11, 2010; and U.S. Provisional Application No. 61/423,818 filed on Dec. 16, 2010, all of which are incorporated by reference herein.

The present invention relates to cosmetic treatments which make it possible to modify the appearance of human keratinous fibers, more particularly but not exclusively the eyelashes.

The invention is targeted in particular at physically lengthening the eyelashes.

BACKGROUND

Generally, users of mascara wish to render their eyelashes more visible by elongation and/or thickening.

The principle of the majority of existing products consists in forming a thick and colored deposit layer and also in shaping the eyelashes. The made-up eyelashes are thus thicker, more colored and more curved.

Mascaras have been proposed which include, in the composition, fibers of a few millimeters. The fixing of the fibers at the end of the eyelashes is random and the result is not sufficiently impressive as it is often scarcely visible.

Another approach consists in adhesively bonding "false eyelashes" to the eyelid or in adhesively bonding small tufts of a few fibers. This introduces a true transformation of the eyelashes and of the fringe in its entirety but requires a professional touch which limits its use on a daily basis. Furthermore, the result is often perceived as being too artificial to be worn every day.

The proposal has also been made to form extensions by hot spinning a material. This route provides a very great physical elongation which is judged to be more natural. However, this approach is not entirely satisfactory for producing long extensions.

Application WO 2006/037904 A1 describes the use of a composition comprising a magnetic filler and the formation of extensions by exposing the composition to a magnetic field at the end of the eyelash.

Application US 2007/0286831 reveals a mascara applicator comprising a heating part and in which the product is provided in the form of bars or beads deposited on the heating part when the latter is in a housing. Feed means comprising a piston, a cylinder or an endless screw are provided in order to bring the product onto the heating part.

Application EP 1 621 101 describes an applicator comprising mascara which is provided in the form of a wound band which a user can bring into contact with a heating part of the applicator.

Application EP 1 955 610 discloses an applicator tip comprising a composition for making up the eyelashes, fitted by push-fitting onto a heating support exhibiting a finger shape, the product extending over the entire circumference of the applicator tip.

Application WO 2006/043544 reveals a device for application of a cosmetic product comprising a unit fitted to a region for receiving a base facing a heating means and receiving the product to be applied once in place on the base.

The problem of the elongation of the eyelashes is longstanding and, to date, the solutions provided are not suitable for the achievement of significant elongation, in a simple and rapid way, without requiring a hand movement which is difficult to reproduce.

SUMMARY

The invention is targeted at meeting this need and it manages this by virtue of an element for the application of fibers to human keratinous fibers, comprising fibers held together in a predefined way by a liquefiable adhesive in the solid form, the liquefying of the adhesive on application making it possible for at least a part of the fibers to separate from the element.

The element can be used to elongate the eyelashes and/or to introduce fibers between the eyelashes and thus to densify the fringe for people with "gaps" in the fringe of eyelashes.

In the case where it is desired to produce extensions, it is preferable to use fibers of a material and thickness in agreement with those of natural eyelashes. In the case of a densifying effect, it is possible to use eyelashes of a thickness and material equivalent to natural eyelashes or different, such as thicker fibers, fibers as tufts, fibers as zigzags, and the like.

The liquefiable adhesive is preferably a hot-melt adhesive.

The fibers are positioned in a predefined way within the element by being, for example, individually positioned separated from one another, preferably substantially parallel to one another, or, in an alternative form, by being grouped together in bundles.

If appropriate, the user is provided with a cutting tool in order to cut the fibers to the desired length, before or after application.

In one embodiment, the fibers are orientated transversely, in particular substantially perpendicularly, to the longitudinal axis of the element.

In an alternative form, the fibers are orientated in a manner substantially parallel to a longitudinal axis of the element.

During application, the fibers are orientated substantially perpendicularly to the fringe.

The fibers can be colored and/or made up beforehand.

The length of the fibers is preferably greater than or equal to 4 mm, being, for example, comprised between 4 and 10 mm. The fibers advantageously exhibit at least one apparent free end, that is to say projecting with respect to the element, for example emerging outside the adhesive.

The fibers can have substantially the same length. In an alternative form, the fibers can have different lengths.

The fibers can have substantially the same spacing. In other words, the fibers are positioned with a certain pitch over the element when they are bonded to the liquefiable adhesive in the solid form. In an alternative form, the fibers can have a variable spacing within the element.

The number of fibers of an element is, for example, comprised between 1 and 300, for example from 10 to 200, for example from 20 to 100, when the element is short in length. However, in the case of an element as a band, of greater length, the number of fibers can be higher.

The adhesive can be chosen from hot-melt adhesives, preferably based on E/VA (ethylene/vinyl acetate) copolymer. The adhesive can comprise a hydrocarbon fatty substance, for example a paraffin, or a silicone fatty substance, for example a PDMS oil. Very preferably, the liquefiable adhesive comprises a coloring agent, advantageously chosen from iron oxides.

The liquefiable adhesive in the solid form can exhibit one or more embossments which may help in the positioning of the element on an application device and/or in the distinguishing of the elements from one another.

In one embodiment, the adhesive forms a self-supporting sheet. In other words, the fibers are rendered integral with one another only by the adhesive.

When the adhesive of the element forms a self-supporting sheet, the fibers can be present over a length of the element of less than or equal to 10 cm, in particular of less than or equal to 6 cm and, for example, comprised between 0.2 and 5 cm.

The element can also comprise a support on which the adhesive is present. This support can be covered on one face only with the adhesive or, in an alternative form, be completely embedded in the adhesive and then acts as an internal frame.

The element can comprise fibers bonded to the support via the liquefiable adhesive and held together via the support.

The fibers can thus be fixed to the support by virtue of adhesive islets connected to one another via the support, it being possible for these adhesive islets each to comprise one or more fibers.

Independently of or in combination with the above, the invention thus relates, according to another of its aspects, to an element for the application of fibers to human keratinous fibers, comprising:

a support, and fibers bonded to the support by a liquefiable adhesive and, for example, positioned in a predefined way.

The invention can make it possible, by liquefying the adhesive prior to application, to detach the fibers from the support and to adhesively bond them to the eyelashes by means of a simple hand movement, in order to achieve a result which is simultaneously very effective in terms of elongation and very attractive.

The support can be a rigid or flexible support, in particular a support as a band. At least a portion of the support can be embedded in the liquefiable adhesive and constitute a frame giving added strength.

The support can be porous or openwork.

The fibers can be positioned in a predefined way on the support, for example be positioned individually on the support, preferably substantially parallel to one another, or, in an alternative form, be grouped together in bundles on the support. The support can be delivered to the user with the fibers prepositioned on the support.

Preferably, the support comprises embossments which make it possible to keep the orientation of the fibers substantially constant with respect to the support once the adhesive has liquefied, during contact with the eyelashes. These embossments comprise, for example, ribs orientated parallel to the fibers.

The support can be ribbed, as mentioned above, and the fibers are then preferably positioned between the ribs, which can facilitate the application of the fibers to the eyelashes. The presence of ribs can also contribute to retaining the adhesive on the support.

The fibers are preferably orientated transversely to a longitudinal axis of the support at a distance from its ends but, in an alternative form, the fibers are positioned at an end of the support, for example with an orientation parallel to its longitudinal axis.

The number of fibers positioned on the support is comprised, for example, between 1 and 300, better still 10 and 200 and even better still 20 and 100.

The support can be coated with liquefiable adhesive between the fibers. The length of the support coated with liquefiable adhesive can, for example, be comprised between 1 and 40 mm, better still 2 and 30 mm, even better still 5 and 20 mm.

The element can be designed to specifically come into contact with the eyelashes of a right eye and/or of a left eye. Thus, the user can be provided with different elements for making up respectively the left eye and the right eye.

The element, comprising or not comprising a support, can comprise one or more markers indicating if it is intended to be brought into contact with the eyelashes of a right eye, or the eyelashes of a left eye.

A marker can, for example, be the color of the support, in the case of an element comprising a support. In this case, an element designed for a right eye comprises a support color which is different from that of an element designed for a left eye.

A marker can also comprise a design and/or one or more characters indicating, to the user, if the element is intended for the eyelashes of a right eye or of a left eye.

Two elements intended for left and right eyes can differ in the orientation of the fibers relative to the support and/or their positioning relative to the support.

A further subject matter of the invention, according to another of its aspects, is a kit comprising:

an element as defined above, with or without support, and an application device comprising a liquefying region on which all or part of the element can be fitted.

The application device can comprise, when the adhesive is a hot-melt adhesive, a heating means, in particular a heating tip, on which the liquefying region is present.

When the element comprises a support, the combination can comprise an application device having a heating tip on which the support can be fixed in detachable fashion. This tip makes it possible to raise the temperature of the adhesive in order to liquefy it.

In particular, a further subject matter of the invention, according to another of its aspects, is a kit comprising:

an application device comprising a heating tip, an element configured in order to be fitted in detachable fashion to the heating tip, this element comprising a support and fibers positioned in orientated fashion on the support, bonded to the latter by a hot-melt adhesive.

The device and the element can be present initially in the same packaging. If appropriate, the packaging can comprise several elements, for example elements specific to the left or right eye and/or intended to provide different results.

The fibers can be positioned in an identical fashion on the different elements. In an alternative form, the packaging can comprise elements from which the fibers and/or their arrangement differ. If appropriate, the packaging can comprise elements from which the fibers and/or their arrangement on the support differ.

For example, the elements can comprise shorter or longer fibers and the user can choose an element according to the makeup which she wishes to produce.

In one embodiment, the application device comprises, within it, a first storage region in which at least one element as defined above is stored.

This application device can additionally comprise a transfer mechanism which makes it possible to bring, to the liquefying region, all or part of an element present in the first storage region.

The element can, for example, be present in the storage region in a wound band form.

When the element is in the band form, the transfer mechanism can make possible a displacement of at least a portion of the element towards the liquefying region. This transfer mechanism can comprise an actuation means which transforms an action of the user into an incremental displacement of the element.

The application device can comprise a return circuit which makes it possible to bring, to a second storage region, all or part of an element present beforehand in the liquefying region. For example, in the case of an element as a band, the band can unwind in the first storage region and then be wound up in the second storage region, after passing through the liquefying region, where the fibers can leave the element in order to be applied to the eyelashes. In this case, the adhesive is carried by a support as a band.

The first storage region can be separate from the second storage region. In an alternative form, first and second storage regions are coincident, for example when the support is a band going round in a closed loop.

In another embodiment, the storage region comprising the element or elements may not be present within the application device but belong to a recharging device.

When it is necessary to place all or part of an element on the liquefying region, the recharging device may be integrally attached in temporary fashion to the application device.

The invention also relates to a cosmetic treatment method, in which:

- fibers of an element as defined above, with or without support, are brought into contact with eyelashes or other human keratinous fibers,
- the adhesive is liquefied, and
- a part at least of the fibers is caused to adhere to the eyelashes or other human keratinous fibers.

The human keratinous fibers can be composed of the eyelashes.

The adhesive applied on the treated eyelashes may not be in contact with the eyelid.

This method can, in addition, comprise a stage which consists in modifying the appearance of the fibers by exposing them to a light, thermal or mechanical stimulus or by bringing them into contact with a third compound. This stage of modifying the appearance of the fibers can take place before, during or after the stage of adhesive bonding of the fibers to the keratinous fibers. It is possible in particular to modify the curvature, the length and the color of the fibers, as will be described in detail below.

Such a method is very particularly suitable for the application of the fibers to the eyelashes.

The length of overlap between the eyelashes and the fibers is, for example, comprised between 1 and 20 mm, better still 1.5 and 15 mm, even better still 2 and 10 mm.

The liquefying of the adhesive can take place by heating the adhesive, for example using an application device comprising a heating means which comprises, for example, a heating tip.

When the element comprises a support, the latter can be separated from the heating means, in particular from the heating tip, after application of the fibers to the keratinous fibers. The support may or may not be separated from the application device after the application of the fibers, according to the presence or absence of a second storage region, as mentioned above.

The invention also relates to a process for the preparation of an element as defined above, comprising the stages consisting in:

- choosing the fibers from one or more type(s) of fibers,
- bringing the chosen fibers into contact with a liquefiable adhesive, preferably a hot-melt adhesive, in the liquid form, and
- allowing the adhesive to solidify, in order to obtain an element as defined above, with or without support.

This allows the user to personalize an element with fibers of her choice, for example produced from her hair.

Another subject matter of the invention is a kit for preparing an element as defined above, comprising:

- one or more type(s) of fibers, and
- a liquefiable adhesive, preferably a hot-melt adhesive, the fibers being intended to be brought into contact with the liquefiable adhesive in the liquid form, in order to form an element as defined above. The kit can comprise a means for positioning and keeping the fibers in their predefined orientation until the adhesive has solidified. The kit can comprise a heating means for liquefying the adhesive.

The invention also relates to a cosmetic treatment method, comprising the stages consisting in:

- making available an element as defined above, with or without support,
- applying a mechanical and/or thermal stimulus to this element, in order to modify the shape thereof and to confer a persistent deformation on the fibers present within this element,
- positioning the element with the fibers thus deformed on a liquefying region of an application device, it being possible for the positioning to take place before or after the application of the mechanical stimulus,
- liquefying the adhesive and bringing the fibers into contact with the region to be treated, in particular the eyelashes.

The application of the mechanical and/or thermal stimulus makes it possible, for example, for an element having a given shape to conform to liquefying regions of different geometry(ies).

The persistent deformation of the fibers can confer a bending effect on the eyelashes and can thus further improve the attractiveness of the makeup.

The mechanical stimulus can be a curving of the element, resulting in a curving of the fibers.

DESCRIPTION OF THE FIGURES

FIG. 8 is a photograph of an example of makeup according to the invention, FIG. 9 diagrammatically and partly represents a transfer mechanism present within an application device according to the invention, FIG. 10 diagrammatically illustrates a method for the persistent deformation of the fibers, and FIG. 11 diagrammatically illustrates a fiber present on an eyelash.

TREATMENT DEVICE

The treatment device can comprise an application device arranged so as to receive the element comprising the fibers bonded by the liquefiable adhesive in the solid form.

The description of the application device in the implementational example where the element comprises fibers bonded by the liquefiable adhesive in the solid form without a support applies to the implementational example where the element comprises a support and also fibers bonded to this support via a liquefiable adhesive.

The application device can in particular be arranged so as to make possible detachable fixing of the element during its use in applying the fibers to the eyelashes.

In particular, the application device can be arranged so as to make possible detachable fixing of the support to a tip intended to carry the support during its use in applying the fibers to the eyelashes.

In a preferred implementational example of the invention, the liquefiable adhesive is a hot-melt adhesive. In this case, the application device which receives the fibers comprises a heating means, in particular a heating tip, which makes it possible to raise the temperature of the adhesive to a value sufficient to bring about the melting thereof.

The application device exhibits, for example, an elongated general shape, comprising a grasping part which can house an electrical source, for example one or more batteries, including a storage battery, and a heating means which makes it possible to produce heat present at the end of the device, on which the element can be fitted.

Figure 1:
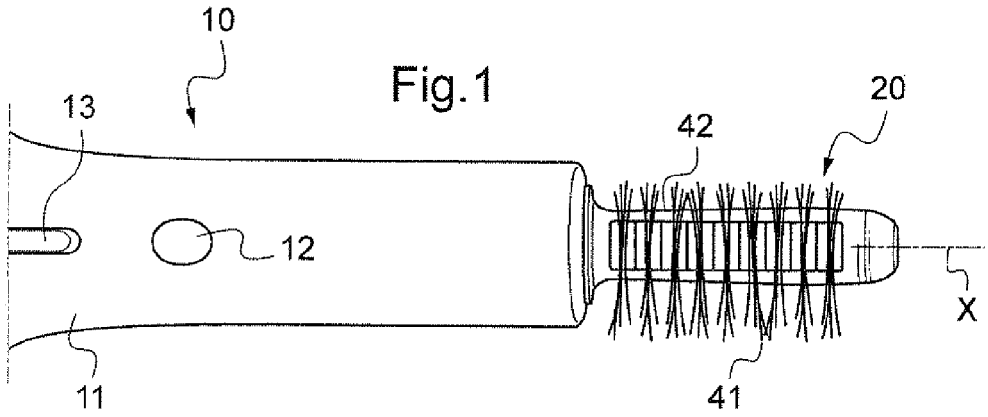
FIG. 1 represents an example of an application device.

FIG. 1 represents an example of an application device 10, in top view. The grasping part 11 has been represented only partially in this figure.

The application device 10 can comprise an indicator light 12 which indicates that it is operating and/or that the temperature necessary for the application has been reached, and also an on/off switch 13.

The application device 10 can house a circuit for controlling the heating means, this control circuit comprising, for example, one or more electronic components which make(s) it possible to regulate the temperature of the heating means, in particular a microcontroller.

The application device 10 can also comprise a temperature sensor, preferably positioned in the heating means and connected to the control circuit.

The grasping part 11 can extend around the energy source. An exit opening can be provided for the removal or the replacement of the energy source.

The heating means can be produced in various ways and can comprise a resistive electrical conductor, coiled or in track form. The heating means is, for example, flexible, for example comprising a polyimide substrate carrying a resistive track.

The heating means can exhibit a substantially flat shape or a shape at least partially curved in transverse cross section. The heating means can also exhibit, in transverse cross section, a dome shape.

The heating means can exhibit, in longitudinal cross section, a substantially flat shape or at least a curved part.

In an implementational example, the heating means exhibits a part crenellated in longitudinal and/or transverse cross section.

The heating means can comprise a metal covering, for example made of stainless steel or of anodized aluminum.

The heating means can define at least partially the region for receiving the element.

The heating means can face, via the metal covering, at least a part of the element.

Generally, the heating means exhibits, for example, a nominal power comprised between 0.5 and 2 W, for example comprised between 0.75 and 1 W, for example of the order of 0.8 W, and makes it possible to achieve a temperature of greater than 50° C., indeed even 60° C., in less than 30 seconds, for example a temperature of greater than 50° C., indeed even 60° C., in less than 2 minutes, better still less than 1 minute, for an ambient temperature of 20° C. The heating means can be arranged so as to exhibit, when operating, a power density comprised between 0.8 W/cm$^2$ and 1.2 W/cm$^2$.

Preferably, the temperature of the heating means is regulated so as to be between values compatible with application. The temperature to which the element is heated is preferably comprised between 50 and 75° C., for example being of the order of 65° C.

The application device 10 can comprise a vibrating source, if appropriate.

Figure 2:
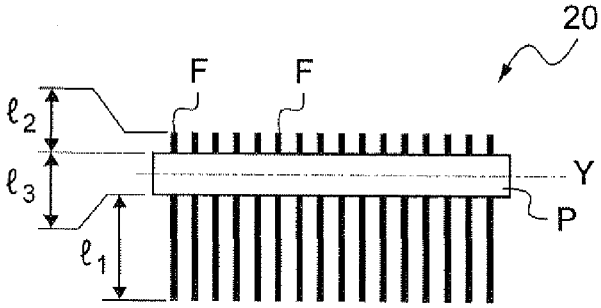
FIGS. 2, 2A and 2B diagrammatically represent implementational examples of elements according to the invention, FIGS. 3 and 3A to 3D diagrammatically represent combinations of elements according to the invention and of heating means, FIGS. 4 and 5 diagrammatically represent other alternative embodiments of elements according to the invention, FIG. 6 diagrammatically represents a kit according to the invention, FIG. 7 diagrammatically represents a method for adhesively bonding the fibers to the eyelashes.

An example of an element 20 comprising an adhesive in the form of a self-supporting sheet, without support, has been represented in isolation in FIG. 2.

The element 20 comprises fibers F, partially embedded in the adhesive composition P. The fibers F are, for example, each embedded in the adhesive over a length of greater than 1 mm, this length preferably being less than 4 mm.

The fibers F can extend individually within the element, as illustrated.

In an alternative form not illustrated, the fibers F are grouped in tufts within the element 20. The number of fibers per tuft is then, for example, between 1 and 40, for example between 2 and 15. Within a tuft, the fibers can be substantially parallel, can exhibit a fan-shaped arrangement or can cut across one another.

The length of the element 20 on which the fibers F are present is, for example, comprised between 0.2 and 6 cm, when the element is unitary, as illustrated in FIG. 2 in particular.

The fibers F can, as illustrated in FIG. 2, inter alia, jut out more from one side than from the other of the body of composition P.

The length $l_1$ over which the fibers F project outside the body according to the composition P can be comprised between 2 and 40 mm, for example between 3 and 30 mm, for example between 4 and 10 mm, whereas, on the opposite side, the length $l_2$ of the projecting fibers can be less, for example less than or equal to 25 mm, 10 mm, for example 5 mm.

In an alternative form not illustrated, the fibers project outside the body of the composition P only from a single side. The fibers can then exhibit only a single free end.

The number of fibers F per element 20 is, for example, comprised between 1 and 300.

The fibers F can extend outside the composition P substantially all in the same plane, which facilitates the application thereof.

Figure 2A:
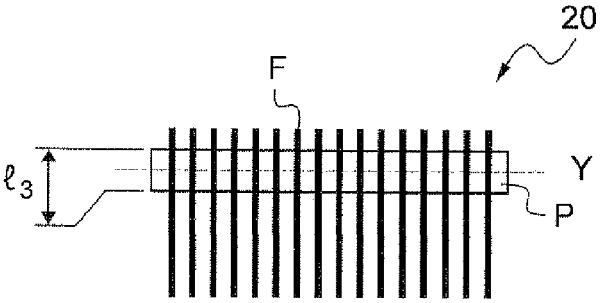

An alternative embodiment of the element 20, in which the fibers F are placed at the surface of the adhesive composition P, has been represented in isolation in FIG. 2A. The fibers may thus be integrally attached to the body of adhesive P only by a portion of their circumference, at the point where they overlap the body of adhesive.

The length $l_3$ over which the fibers F are placed is, for example, comprised between 1 and 4 mm.

The ratio of the total length of the fibers F of the element 20 to the length $l_3$ over which the latter are embedded in adhesive or placed on the latter is, for example, as is the case in the examples of FIGS. 2 and 2A, comprised between 0.5 and 40, better still comprised between 1 and 10, even better still between 1 and 6.

Figure 2B:
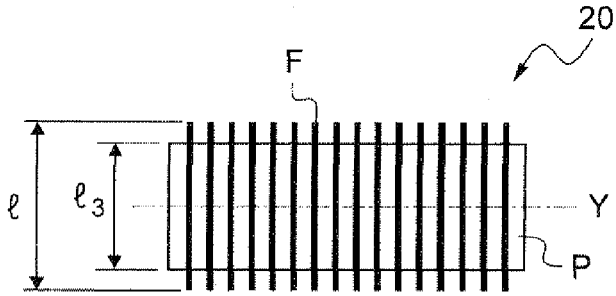

In the alternative form illustrated in FIG. 2B, the fibers F are placed on the adhesive composition P over a major part of their length, over a length $l_3$, for example, comprised between 2 and 12 mm.

The ratio of the total length l of the fibers F of the element 20 to the length $l_3$ is, for example, comprised between 1 and 2, for example between 1 and 1.5.

In an alternative form, not illustrated, of FIG. 2B, the fibers F are embedded in the adhesive composition P over most of their length, instead of being placed on the body of adhesive.

The longitudinal axis Y of the element 20 can be transversal or substantially parallel to the longitudinal axis of the application device, when the element 20 is in place on the latter.

Various shapes can be given to the body of adhesive.

Preferably, the body of adhesive is provided in the form of a sheet elongated along the Y axis, of flattened shape.

The element 20 is intended to be brought into contact with or close to a liquefying region, in order for the adhesive to change to the liquid state and for the fibers to be able to be detached from the element.

When the adhesive is a hot-melt adhesive, the liquefying region is defined by a heating means.

Figure 3:
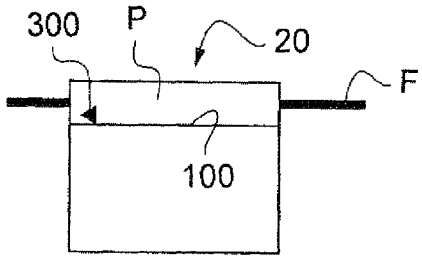

An implementational example where the liquefying region 100 and the adhesive composition P both exhibit, in transverse cross section, a substantially flat shape has been represented in FIG. 3.

There is preferably contact between the heating means and the element 20 in order to facilitate the liquefying of the adhesive.

The element can, as represented in FIG. 3, comprise a visual indicator 300 which indicates, to the user, the face of the element to be positioned on the heating means.

The visual indicator 300 can, as illustrated, be in the form of a geometrical pattern. It is also possible to employ characters, designs or colors, this list not being limiting.

Figure 3A:
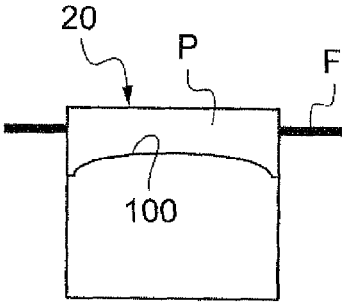
Figure 3B:
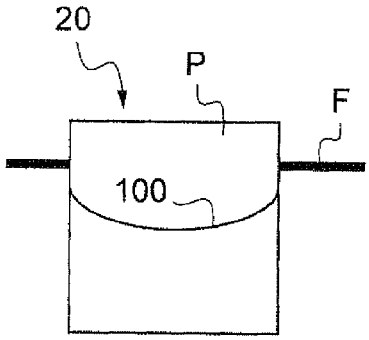

FIGS. 3A and 3B illustrate implementational examples where the liquefying region and adhesive composition P exhibit complementary shapes, for example substantially curved shapes, convex for the liquefying region 100 and concave for the opposing face of the element 20 for the example of FIG. 3A and conversely for the example of FIG. 3B.

Figure 3C:
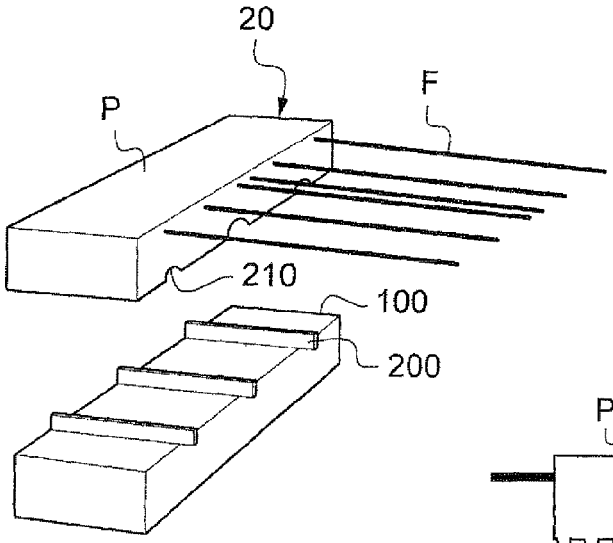
Figure 3D:
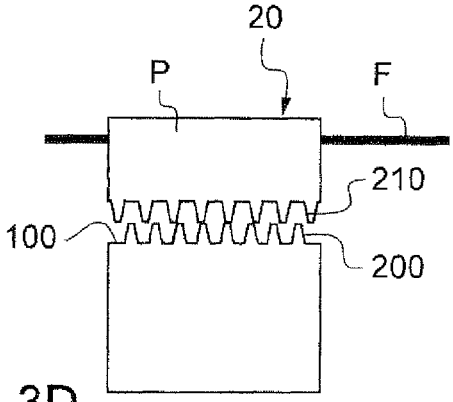

It is also possible for the adhesive composition P and the liquefying region to exhibit a plurality of interacting embossments 200 and 210, either in the transverse direction, as illustrated in FIG. 3C, or in the longitudinal direction, as illustrated in FIG. 3D.

The shape of the element 20 can be modified under the action of a thermal or mechanical stimulus.

It is possible, for example, to modify the shape of the application element 20 by exerting a mechanical stress with the hand, using a tool or using the application device itself.

An element 20 which can deform under the action of a stress exerted with the hand has been represented in FIG. 10. The user takes element 20 between two of her fingers D, for example the index finger and the thumb, and imposes a curvature on it, for example around its longitudinal axis. Following this stress, the fibers F and the sheet of adhesive of the element 20 acquire a persistent curvature. The element 20 is then placed on a liquefying region of suitable shape and the adhesive composition P is liquefied by heating. Eyelashes C are brought into contact with the adhesive composition P thus liquefied and the fibers and, after withdrawal of the eyelashes C, the fibers F remain fixed to the eyelashes C and exhibit a persistent curvature, which produces a particularly attractive bending effect on the eyelashes.

An example of a transfer mechanism within an alternative form of the application device has been represented in FIG. 9. In this implementational example, the element 20 is in the form of a band and comprises a support in the form of a band. The element 20 which has not yet been introduced into the liquefying region 100 is initially present in a storage region in the form of a first roller 62.

The user rotates the first roller 62 so as to bring an as yet unused portion of the element 20, carrying fibers F, from the storage region to the liquefying region 100, in order to make possible the adhesive bonding of the fibers F to the eyelashes C.

After liquefying the adhesive composition and adhering the fibers F to the eyelashes C, the portion thus used of the application element 20 follows a return circuit to a second roller 63 within a second storage region. As illustrated, fibers may remain on the portion of the application element 20 reaching the return circuit.

Use may also be made of transfer means such as a piston or a cylinder, as described in US 2007/0286831.

Figure 4:
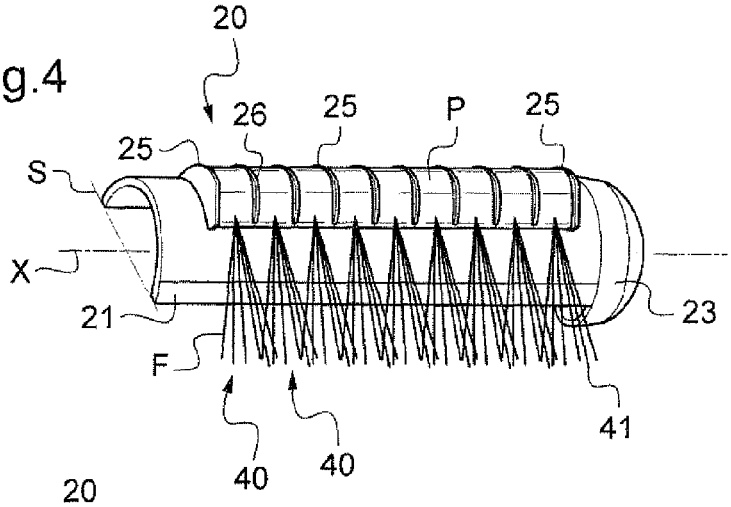

An example of an element 20 comprising a support 21 has been represented in isolation in FIG. 4.

The fixing of the support 21 to the heating tip can be carried out in various ways, for example by push-fitting, magnetic attraction and/or snapping.

If appropriate, a device for ejection of the support 21 is provided on the application device 10, this ejection device being actuated by the user to act on the support 21 in order to eject the latter or at the very least to facilitate the removal thereof by the user.

In the example illustrated in FIG. 4, the support 21 has a shape elongated along longitudinal axis X of the application device 10.

In alternative forms not illustrated, the orientation of the longitudinal axis of the support 21 is not coaxial with that of the device which carries it, for example being perpendicular to the longitudinal axis of the application device.

In FIG. 4, it is seen that the support 21 can comprise a body elongated along a longitudinal axis, having a shape suited to the fitting thereof to the heating tip. The support 21 can exhibit a portion of transverse cross section having a concave shape towards the heating tip. The support 21 can comprise a distal end part 23 in the shape of a dome, arranged in order to engage with the heating tip so as to keep the support 21 in place on the tip. The support 21 can comprise any coupling means, for example arranged in order to make possible fixing by clamping or snapping in a housing or on a corresponding embossment of the application device 10, so as to retain the support 21 on the heating tip.

In the example illustrated, the support 21 carries ribs 25 which are parallel and generally perpendicular to the longitudinal axis X, these ribs 25 being, for example, evenly spaced along the axis X. A composition P comprising a hot-melt adhesive is present between the ribs 25.

Each rib 25 exhibits, for example, a rounded upper edge 26 convexed towards the outside.

The support 21 is, for example, molded from a single part made of a thermoplastic optionally comprising, as filler, inorganic particles or fibers, for example of metal oxides, or glass or carbon black powder or fiber, for example a polyolefin, such as polyethylene or polypropylene, or, in an alternative form, made of nonpolyolefinic materials, such as acrylonitrile/butadiene/styrene (ABS) or polyoxymethylene (POM).

The fibers F are carried by the support 21, being partially embedded in the adhesive composition P.

In the example of FIG. 4, the fibers F are grouped in tufts 40 each positioned in the interval between two consecutive ribs 25. The fibers can have, as represented, a free end 41 distant from the body of composition P retained between two ribs 25 and an opposite end 42 which is either completely embedded in the body of composition P extending between two ribs 25 or which in fact slightly projects, as illustrated in FIG. 1.

Preferably, the fibers F are positioned relative to the support 21, whether they are or are not grouped in tufts, so that they jut out more from one side than from the other. Thus, the length by which the fibers F jut out from one side of the support, projecting outside the body of composition P, can be comprised between 2 and 40 mm, better still 3 and 30 mm and even better still 4 and 10 mm, whereas, on the opposite side, the length of the projecting fibers is either zero or less than or equal to 25 mm, 10 mm, even better still 5 mm.

The number of fibers per tuft 40 is, for example, between 1 and 40, better still 2 and 15. With a tuft 40, the fibers F can be substantially parallel, can exhibit a fan-shaped arrangement or can cut across one another.

The fibers F can extend out of the composition P substantially all in the same plane, which can facilitate the application thereof, this plane being, for example, parallel to the X axis and, for example, parallel to a plane S defined by the lower longitudinal edges of the support 21. This plane comprising the fibers can also form an angle with the plane S.

Figure 5:
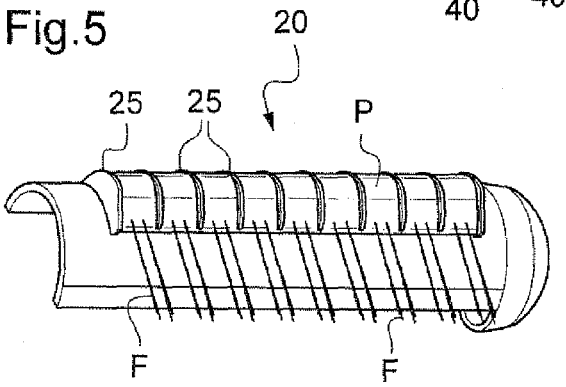

An alternative embodiment in which the fibers F are not grouped in tufts but extend individually within the element 20, being parallel to one another, has been represented in FIG. 5. In this case, the number of fibers F sunk into the composition P between two consecutive ribs 25 is, for example, comprised between 1 and 50, better still 2 and 40.

The support 21 can have any shape which makes it possible to maintain the fibers with the desired orientation when the composition P is in the molten state.

The support thus advantageously comprises, as described above, ribs between which the fibers are positioned.

Of course, the invention is not limited to a specific embodiment of the support and the fibers can be maintained on the support with the desired orientation in various ways and, for example, without use of ribs, the support comprising, for example, protrusions for holding the fibers in place when the adhesive is in the molten state.

If appropriate, the fibers can be maintained on the support with the desired orientation independently of any embossment present on the support, by virtue, for example, of a suitable viscosity of the composition P.

The support 21 exhibits, in the example of FIG. 4, a shape elongated along a rectilinear longitudinal axis. It would not be departing from the scope of the present invention to give other shapes to the support 21, for example with a curvilinear longitudinal axis. In an alternative form, the fibers extend generally parallel to the longitudinal axis of the support, at the end of the latter, or are positioned at the end of the heating tip, in a plane generally perpendicular to the longitudinal axis of the application tool.

Figure 6:
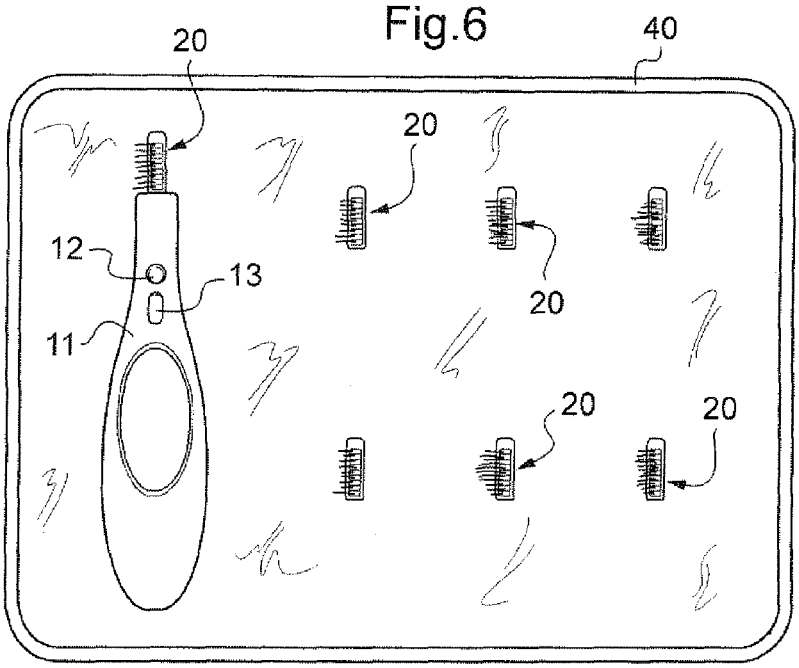

The elements can be sold with the application device in a common packaging 40, for example a blister pack, as illustrated in FIG. 6, comprising a plurality of elements 20 and the application device 10, on which is already fixed, if appropriate, an element 20. The elements can comprise identical or different fibers.

When applied on the eyelashes (C), the fibers (F) may, as shown in FIG. 11, not be in contact with the eyelid (E).

In particular, the adhesive (not shown) connecting the fiber (F) to the eyelash (C) may be situated in a region distant from the eyelid (E) of a distance ($d_1$) which is at least equal to 5%, for example 10%, of the length ($d_2$) of the considered eyelash (C).

Fibers

Use may be made of various types of fibers F, without departing from the scope of the present invention.

The fibers are, for example, of natural or synthetic origin.

Use may be made, for example, of head hair, body hairs of animals or synthetic fibers made, for example, of thermoplastic.

For example, use may be made of fibers made of one of the thermoplastics chosen from polyolefins and polyamides.

The fibers F can, when they are synthetic, be made of one or several materials. Use may in particular be made of fibers comprising a sheath made of a first material covering a core made of a second material.

The fibers may or may not be colored. For example, the fibers can be black or can have a color other than black, for example being made of a material colored throughout its body or coated with a colored sheath. The fibers can be chosen so as to have the natural color of the eyelashes of the user.

The fibers F can comprise pigments or dyes, generating a color by absorption and/or by luminescence.

The fibers F can have various shapes in transverse cross section, for example can be of circular or noncircular cross section, for example polygonal cross section, in the shape of a tile, or may or may not be hollow, the external diameter of the fibers being, for example, comprised between 0.1 and 3 mm, better still 0.2 and 2 mm, even better still 0.5 and 1.5 mm.

The fibers can be produced with a uniform transverse cross section over their entire length or, in an alternative form, with a decreasing transverse cross section, for example decreasing in the direction of at least one free end 41.

When the adhesive of the element is carried by a support, the fibers can, for example, be produced with a transverse cross section which decreases in the direction of the free end most distant from the support.

The fibers F can have a smooth or rough surface state, it being possible for a degree of roughness to facilitate the attachment of mascara.

The fibers may or may not be rectilinear, for example wavy.

The length of each fiber is preferably comprised between 1 and 50 mm, better still 2 and 25 mm, even better still 4 and 15 mm, in the case of use for lengthening the eyelashes.

At least one characteristic of the fibers can vary in response to a light, thermal or mechanical stimulus or by being brought into contact with a third compound.

This characteristic which can vary under the action of a stimulus can, for example, be chosen from: the shape, the length or the optical properties, in particular the color, the reflectance and the opacity of the fibers.

In one embodiment, the fiber can change in curvature along its longitudinal axis, in particular can curve up, or can have an apparent length which varies following the action of at least one of the abovementioned stimuli.

It is, for example, possible for the fibers to change in curvature, in particular to curve up, under the action of heating.

The fibers F carried by one and the same element 20 can all be identical or, in an alternative form, can be different.

For example, one and the same element 20 can comprise a mixture of fibers of different colors and/or with different properties, for example with different lengths, with different cross sections and/or with different surface states.

Once in place on the adhesive of the element 20, the fibers F can be subjected to a treatment targeted, for example, at modifying their length, the shape of their end and/or their surface state and/or their appearance.

If appropriate, the fibers F can be subjected to a treatment targeted, for example, at modifying their length, the shape of their end and/or their surface state and/or their appearance, once in place on the support 21.

It is possible, for example, to cut the fibers so that all the ends 41 are aligned along an axis parallel to the axis X. It is also possible to cut the fibers so as to render their lengths slightly different and to give a more natural appearance to the makeup.

When the fibers are in place on the element or before this deployment on the adhesive or the support 21, the fibers can be coated with a makeup product.

When the fibers are in place on the support 21 or before this deployment on the support 21, the fibers can be coated with a makeup product.

The fibers F can be coated over their entire length by the liquefiable adhesive or by any compound intended, for example, to improve the attachment of the liquefiable adhesive to the fibers F. This coating can take place, when the element comprises a support, before the fixing of the fibers to the support. The fibers can also comprise portions which are not coated by the adhesive composition, at least before the element is heated on the application device.

In particular when the element comprises a support, the deployment of the fibers on the support 21 can be carried out while the fibers are integrally attached to one or more reels. The support 21 can be covered with liquid adhesive, under hot conditions, and then the fibers are sunk into the adhesive while being held between guides. After cooling the adhesive, the fibers are cut, on one side level with the support and, on the other side, while leaving the desired length to jut out.

The precut fibers can also be positioned against the support or, in the absence of support, against the mold while holding them using a gripping jaw, then the adhesive is cast in the liquid state over the support and the gripping jaw releases the fibers after the adhesive has set.

It is also possible to bring the fibers as a reel against a sheet of unwound or extruded adhesive and to press, under hot conditions, the fibers against the sheet in order to render them integral with the sheet.

Liquefiable Adhesive

The composition can comprise, indeed can even be composed entirely of, the liquefiable adhesive. The latter can be a hot-melt adhesive.

The adhesive can comprise, indeed can even be composed of, a compound chosen from the following:

A/ Polymers and copolymers comprising at least one alkene monomer, in particular ethylene-based copolymers.

Such compounds can be chosen from:

copolymers of alkene and of vinyl acetate, in particular copolymers of ethylene and of vinyl acetate.

Use may in particular be made of the copolymers of ethylene and of vinyl acetate preferably comprising more than 25% by weight of vinyl acetate, with respect to the total weight of the polymer.

Mention may be made, as examples of ethylene/vinyl acetate copolymers, of those which are sold under the Elvax name by Du Pont de Nemours and in particular the compounds Elvax 40W, Elvax 140 W, Elvax 200 W, Elvax 205W, Elvax 210 W and Elvax 310.

Mention may also be made of the products sold under the Evatane name by Arkema, such as Evatane 28-800. Mention may also be made of Melthene-H Grade H-6410M, provided by Tosoh Polymer.

copolymers of ethylene and of octene, such as, for example, the products sold under the "Affinity" reference by Dow Plastics, for example Affinity GA 1900 and GA 1950.

These polymers and copolymers can be used alone or as a mixture with at least one compound chosen from "tackifying" resins, such as described in the Handbook of Pressure Sensitive Adhesives, edited by Donatas Satas, 3rd ed., 1989, pp. 609-619, waxes, and their combinations. The tackifying resins can in particular be chosen from rosin, rosin derivatives, hydrocarbon resins and their mixtures.

Mention may be made, as mixtures based on ethylene/vinyl acetate copolymer, for example of the products sold under the Coolbind name by National Starch.

Use may also be made of mixtures of ethylene/vinyl acetate copolymer and of paraffin. For example, it is possible to use a mixture comprising 55.5% by weight of ethylene/vinyl acetate copolymer, 44% by weight of paraffin and 0.5% by weight of preservative.

These polymers can be provided in their pure form or can be conveyed in an aqueous phase or an organic solvent phase.

B/ Polyvinyl acetate homopolymers, preferably exhibiting a molecular weight of less than 20 000, for example Raviflex BL1S from Vinavil.

C/ Silicone resins

These resins are crosslinked organosiloxane polymers.

The nomenclature of silicone resins is known under the "MDTQ" name, the resin being described according to the various monomeric siloxane units which it comprises, each of the "MDTQ" letters characterizing one type of unit.

The letter M represents the monofunctional unit of formula $(CH_3)_3SiO_{1/2}$, the silicon atom being connected to a single oxygen atom in the polymer comprising this unit.

The letter D means a difunctional unit $(CH_3)_2SiO_{2/2}$ in which the silicon atom is connected to two oxygen atoms.

The letter T represents a trifunctional unit of formula $(CH_3)SiO_{3/2}$.

In the M, D and T units defined above, at least one of the methyl groups can be replaced by a group R which is different from the methyl group, such as a hydrocarbon (in particular alkyl) radical having from 2 to 10 carbon atoms or a phenyl group or alternatively a hydroxyl group.

Finally, the letter Q means a tetrafunctional unit $SiO_{4/2}$ in which the silicon atom is bonded to four oxygen atoms, themselves bonded to the remainder of the polymer.

Mention may in particular be made of T resins, especially functionalized T silicone resins, such as polyphenylsiloxanes, especially functionalized by silanol (Si—OH) groups, such as that sold under the reference Dow Corning (R) Z-1806.

D/ Film-forming block ethylenic polymers

These polymers preferably comprise at least one first block and at least one second block having different glass transition temperatures (Tg), said first and second blocks being connected to one another via an intermediate block comprising at least one constituent monomer of the first block and at least one constituent monomer of the second block.

Advantageously, the first and second blocks of the block polymer are incompatible with one another.

Such polymers are described, for example, in the documents EP 1 411 069 or WO 04/028488 or WO 04/028493.

The term "block" polymer is understood to mean a polymer comprising at least 2 distinct blocks, for example at least 3 distinct blocks.

The first and second blocks of the polymer differ from one another in their degree of deformability. Thus, the first block can be rigid and the second block can be flexible.

The glass transition temperatures of the flexible and rigid blocks can be theoretical Tg values determined from the theoretical Tg values of the constituent monomers of each of the blocks, which can be found in a reference handbook, such as the Polymer Handbook, 3rd ed., 1989, John Wiley, according to the following relationship, referred to as the Fox Law:

$$1/Tg = \sum_i (\acute{\omega}_i / Tg_i),$$

$\acute{\omega}_i$ being the mass fraction of the monomer i in the block under consideration and $Tg_i$ being the glass transition temperature of the homopolymer of the monomer i.

Unless otherwise indicated, the Tg values indicated for the first and second blocks in the present patent application are theoretical Tg values.

The rigid block can have a Tg of greater than 20° C.

The flexible block can have a Tg of less than or equal to 20° C.

According to one embodiment, the copolymer comprises a first rigid block and a second flexible block.

Preferably, the proportion of the rigid block ranges from 20 to 90% by weight of the copolymer, better still from 30 to 90% by weight and even better still from 50 to 90% by weight.

Preferably, the proportion of the flexible block ranges from 5 to 75% by weight of the copolymer, preferably from 10 to 50% by weight and better still from 15 to 45% by weight.

Rigid Block

In the context of the present invention, the rigid block or blocks are more particularly formed from the following monomers:

methacrylates of formula $CH_2{=}C(CH_3){-}COOR_1$ in which $R_1$ represents an unsubstituted linear or branched $C_1$ to $C_4$ alkyl group, such as a methyl, ethyl, propyl or isobutyl group, or $R_1$ represents a $C_4$ to $C_{12}$ cycloalkyl group, such as an isobornyl group, acrylates of formula $CH_2{=}CH{-}COOR_2$ in which $R_2$ represents a tert-butyl group or a $C_4$ to $C_{12}$ cycloalkyl group, such as an isobornyl group, (meth)acrylamides of formula:

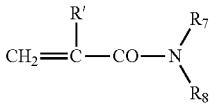

where $R_7$ and $R_8$ are identical or different and each represent a hydrogen atom or a linear or branched $C_1$ to $C_{12}$ alkyl group, such as an n-butyl, t-butyl, isopropyl, isohexyl, isooctyl or isononyl group, or $R_7$ represents H and $R_8$ represents a 1,1-dimethyl-3-oxobutyl group, and R' denotes H or methyl.

Mention may be made, as example of monomers of this type, of N-butylacrylamide, N-(t-butyl)acrylamide, N-isopropylacrylamide, N,N-dimethylacrylamide and N,N-dibutylacrylamide, and their mixtures.

Particularly preferred monomers of the rigid block are isobornyl methacrylate, isobornyl acrylate and their mixtures.

Flexible Block

In the context of the present invention, the flexible block or blocks are more particularly formed from the following monomers:

acrylates of formula $CH_2{=}CHCOOR_3$, with $R_3$ representing an unsubstituted linear or branched $C_1$ to $C_{12}$ alkyl group, such as an isobutyl group (with the exception of a tert-butyl group), in which one or more heteroatoms chosen from O, N and S is/are optionally intercalated, methacrylates of formula $CH_2{=}C(CH_3){-}COOR_4$, with $R_4$ representing an unsubstituted linear or branched $C_6$ to $C_{12}$ alkyl group in which one or more heteroatoms chosen from O, N and S is/are optionally intercalated;

vinyl esters of formula $R_5{-}CO{-}O{-}CH{=}CH_2$ where $R_5$ represents a linear or branched $C_4$ to $C_{12}$ alkyl group;

$C_4$ to $C_{12}$ alkyl vinyl ethers;

and their mixtures.

Particularly preferred monomers of the flexible block are isobutyl acrylate.

Each of the blocks can comprise a minor proportion of at least one constituent monomer of the other block.

Thus, the first block can comprise at least one constituent monomer of the second block, and vice versa.

Each of the first and/or second blocks can comprise, in addition to the monomers indicated above, one or more other monomers, known as additional monomers, which are different from the main monomers mentioned above.

This additional monomer is chosen, for example, from:

a) hydrophilic monomers, such as:

monomers possessing ethylenic unsaturation(s), other than acrylic acid, comprising at least one carboxylic or sulfonic acid functional group, such as, for example, methacrylic acid, crotonic acid, maleic anhydride, itaconic acid, fumaric acid, maleic acid, acrylamidopropanesulfonic acid, vinylbenzoic acid or vinylphosphonic acid, and the salts of these, monomers possessing ethylenic unsaturation(s) comprising at least one tertiary amine functional group, such as 2-vinylpyridine, 4-vinylpyridine, dimethylamino-ethyl methacrylate, diethylamino ethyl methacrylate, dimethylaminopropylmethacrylamide and the salts of these, methacrylates of formula $CH_2{=}C(CH_3){-}COOR_6$ in which $R_6$ represents a linear or branched alkyl group comprising from 1 to 4 carbon atoms, such as a methyl, ethyl, propyl or isobutyl group, said alkyl group being substituted by one or more substituents chosen from hydroxyl groups (such as 2-hydroxypropyl methacrylate or 2-hydroxyethyl methacrylate) and halogen atoms (Cl, Br, I, F), such as trifluoroethyl methacrylate, methacrylates of formula $CH_2{=}C(CH_3){-}COOR_9$, $R_9$ representing a linear or branched $C_6$ to $C_{12}$ alkyl group in which one or more heteroatoms chosen from O, N and S is/are optionally intercalated, said alkyl group being substituted by one or more substituents chosen from hydroxyl groups and halogen atoms (Cl, Br, I, F);

acrylates of formula $CH_2{=}CHCOOR_{10}$, $R_{10}$ representing a linear or branched $C_1$ to $C_{12}$ alkyl group substituted by one or more substituents chosen from hydroxyl groups and halogen atoms (Cl, Br, I and F), such as 2-hydroxypropyl acrylate and 2-hydroxyethyl acrylate, or $R_{10}$ representing a ($C_1$-$C_{12}$)alkyl-O—POE (polyoxyethylene) with repetition of the oxyethylene unit from 5 to 30 times, for example methoxy-POE, or $R_{10}$ representing a polyoxyethylene group comprising from 5 to 30 ethylene oxide units, b) monomers possessing ethylenic unsaturation(s) comprising one or more silicon atoms, such as methacryloyloxypropyltrimethoxysilane or methacryloyloxypropyltris(trimethylsiloxy)silane, and their mixtures.

This or these additional monomers generally represent(s) an amount of less than or equal to 30% by weight, for example from 1 to 30% by weight, preferably from 5 to 20% by weight and more preferably from 7 to 15% by weight, of the total weight of the first and/or second blocks.

According to one embodiment, the copolymer can comprise at least one first block and at least one second block connected to one another via an intermediate segment comprising at least one constituent monomer of the first block and at least one constituent monomer of the second block.

Preferably, the intermediate block results essentially from constituent monomers of the first block and of the second block.

Advantageously, the intermediate segment comprising at least one constituent monomer of the first block and at least one constituent monomer of the second block of the copolymer is a random polymer.

Advantageously, the copolymer results essentially from monomers chosen from alkyl methacrylates, alkyl acrylates and their mixtures.

The term "essentially" is understood to mean, in that which precedes and in that which follows, comprising at least 85%, preferably at least 90%, better still at least 95% and even better still 100%.

As regards the acrylate and methacrylate esters, they can derive from the esterification of linear or branched, cyclic or aromatic $C_1$ to $C_{12}$ alcohols, in particular $C_4$ to $C_{10}$ alcohols.

Mention may in particular be made, by way of illustration and without implied limitation of these alcohols, of isoborneol.

According to one embodiment, said copolymer comprises at least acrylate and methacrylate monomers deriving from the esterification of the same alcohol and in particular isoborneol.

Preferably, the film-forming linear block polymer comprises at least isobornyl acrylate monomers, at least isobornyl methacrylate monomers and at least isobutyl acrylate monomers.

According to an alternative embodiment, the block polymer can comprise at least:

a rigid block, which is an isobornyl methacrylate/isobornyl acrylate copolymer, and a flexible block, which is an isobutyl acrylate copolymer.

More specifically, the copolymer can comprise from 50 to 80% by weight of isobornyl methacrylate/acrylate and from 10 to 20% by weight of isobutyl acrylate.

The weight-average molecular weight (Mw) of the copolymer preferably ranges from 80 000 to 300 000, indeed even from 100 000 to 150 000.

The number-average molecular weight (Mn) of the copolymer preferably ranges from 20 000 to 90 000, for example from 25 000 to 45 000.

E/ Copolymers of dienes and of styrene, in particular copolymers of butadiene and of styrene.

Mention may in particular be made of the styrene/butadiene copolymers sold under the Pliolite S5E reference by Eliokem.

F/ Polyesters comprising at least one monomer carrying at least one —$SO_3M$ group (M representing a hydrogen atom, an ammonium ion $NH_4^+$ or a metal ion), also known as sulfopolyesters.

These polyesters advantageously have a glass transition temperature (Tg) of greater than 38° C.

They can exhibit a weight-average molecular weight advantageously of less than 200 000, for example ranging from 10 000 to 50 000.

These polyesters can be obtained in a known way by polycondensation of at least one dicarboxylic acid with at least one polyol, in particular diols.

The dicarboxylic acid can be aliphatic, alicyclic or aromatic. Mention may be made, as examples of such acids, of: oxalic acid, malonic acid, dimethylmalonic acid, succinic acid, glutaric acid, adipic acid, pimelic acid, 2,2-dimethylglutaric acid, azelaic acid, suberic acid, sebacic acid, fumaric acid, maleic acid, itaconic acid, phthalic acid, dodecanedioic acid, 1,3-cyclohexanedicarboxylic acid, 1,4-cyclohexanedicarboxylic acid, isophthalic acid, terephthalic acid, 2,5-norbornanedicarboxylic acid, diglycolic acid, thiodipropionic acid, 2,5-naphthalenedicarboxylic acid or 2,6-naphthalenedicarboxylic acid. These dicarboxylic acid monomers can be used alone or as a combination of at least two dicarboxylic acid monomers. The choice is preferably made, among these monomers, of phthalic acid, isophthalic acid or terephthalic acid.

The diol can be chosen from aliphatic, alicyclic or aromatic diols. Use is preferably made of a diol chosen from: ethylene glycol, diethylene glycol, triethylene glycol, 1,3-propanediol, cyclohexanedimethanol or 1,4-butanediol.

Use may be made, as other polyols, of glycerol, pentaerythritol, sorbitol or trimethylolpropane.

Polyesteramides can be obtained analogously to the polyesters by polycondensation of diacids with diamines or aminoalcohols. Use may be made, as diamines, of ethylenediamine, hexamethylenediamine, meta-phenylenediamine or para-phenylenediamine. Use may be made, as amino alcohol, of monoethanolamine.

The polyester comprises at least one monomer carrying at least one —$SO_3M$ group, with M representing a hydrogen atom, an ammonium ion $NH_4^+$ or a metal ion, such as, for example, an $Na^+$, $Li^+$, $K^+$, $Mg^{2+}$, $Ca^{2+}$, $Cu^{2+}$, $Fe^{2+}$ or $Fe^{3+}$ ion. Use may in particular be made of a bifunctional aromatic monomer comprising such an —$SO_3M$ group.

The aromatic ring system of the bifunctional aromatic monomer additionally carrying an —$SO_3M$ group as described above can be chosen, for example, from the benzene, naphthalene, anthracene, biphenyl, oxydiphenyl, sulfonyldiphenyl or methylenediphenyl ring systems. Mention may be made, as example of bifunctional aromatic monomer additionally carrying an —$SO_3M$ group, of: sulfoisophthalic acid, sulfoterephthalic acid, sulfophthalic acid or 4-sulfonaphthalene-2,7-dicarboxylic acid.

It is preferable to use copolymers based on isophthalate/sulfoisophthalate and more particularly copolymers obtained by condensation of diethylene glycol, cyclohexanedimethanol, isophthalic acid and sulfoisophthalic acid.

Such polymers are sold, for example, under the Eastman AQ® trade name by Noveon, for example Eastman AQ 38S.

G/ Waxes

The wax under consideration in the context of the present invention is generally a lipophilic compound which is solid at ambient temperature (25° C.), which is or is not deformable, which exhibits a reversible solid/liquid change in state and which has a melting point of greater than or equal to 30° C. which can range up to 100° C. and in particular up to 90° C.

On bringing the wax to the liquid state (melting), it is possible to render it miscible with oils and to form a microscopically homogeneous mixture but, on bringing the temperature of the mixture back to ambient temperature, recrystallization of the wax in the oils of the mixture is obtained.

In particular, the waxes suitable for the invention can exhibit a melting point of greater than or equal to 45° C. and in particular of greater than or equal to 55° C.

Within the meaning of the invention, the melting point corresponds to the temperature of the most endothermic peak observed by thermal analysis (DSC) as described in the standard ISO 11357-3; 1999. The melting point of the wax can be measured using a differential scanning calorimeter (DSC), for example the calorimeter sold under the name "MDSC 2920" by TA Instruments.

The measurement protocol is as follows:

A 5 mg sample of wax placed in a crucible is subjected to a first rise in temperature ranging from −20° C. to 100° C. at a heating rate of 10° C./minute, is then cooled from 100° C. to −20° C. at a cooling rate of 10° C./minute and, finally, is subjected to a second rise in temperature ranging from −20° C. to 100° C. at a heating rate of 5° C./minute. During the second rise in temperature, the variation in the difference in power absorbed by the empty crucible and by the crucible comprising the sample of wax is measured as a function of the temperature. The melting point of the compound is the value of the temperature corresponding to the tip of the peak of the curve representing the variation in the difference in power absorbed as a function of the temperature.

The waxes capable of being used in the compositions according to the invention are chosen from waxes of animal, vegetable, mineral or synthetic origin, and their mixtures, which are solid at ambient temperature.

The waxes which can be used in the compositions according to the invention generally exhibit a hardness ranging from 0.01 MPa to 15 MPa, in particular of greater than 0.05 MPa and especially of greater than 0.1 MPa.

The hardness is determined by the measurement of the compressive force measured at 20° C. using a texture analyzer sold under the name TA-XT2 by Rheo, equipped with a stainless steel cylinder with a diameter of 2 mm which is displaced at the measuring rate of 0.1 mm/s and which penetrates the wax to a penetration depth of 0.3 mm.

The measurement protocol is as follows:

The wax is melted at a temperature equal to the melting point of the wax +10° C. The molten wax is cast in a receptacle with a diameter of 25 mm and a depth of 20 mm. The wax is recrystallized at ambient temperature (25° C.) for 24 hours, so that the surface of the wax is flat and smooth, and then the wax is stored at 20° C. for at least one hour before measuring the hardness or the tack.

The spindle of the texture analyzer is displaced at a rate of 0.1 mm/s and then penetrates the wax to a penetration depth of 0.3 mm. When the spindle has penetrated the wax to the depth of 0.3 mm, the spindle is held stationary for 1 second (corresponding to the relaxation time) and is then withdrawn at the rate of 0.5 mm/s.

The value of the hardness is the maximum compressive force measured divided by the surface area of the cylinder of the texture analyzer in contact with the wax.

Mention may in particular be made, by way of illustration of the waxes suitable for the invention, of hydrocarbon waxes, such as beeswax, lanolin wax and Chinese insect waxes; rice bran wax, carnauba wax, candelilla wax, ouricury wax, esparto wax, berry wax, shellac wax, Japan wax and sumac wax; montan wax, orange and lemon waxes, microcrystalline waxes, paraffin waxes and ozokerite; polyethylene waxes, the waxes obtained by the Fischer-Tropsch synthesis and waxy copolymers, and their esters, waxes obtained by catalytic hydrogenation of animal or vegetable oils having linear or branched $C_8$-$C_{32}$ fatty chains, such as isomerized jojoba oil, hydrogenated sunflower oil, hydrogenated castor oil, hydrogenated coconut oil, hydrogenated lanolin oil and di(1,1,1-trimethylolpropane)tetrastearate, sold under the name of Hest 2T-4S® by Heterene.

Mention may also be made of silicone waxes or fluorinated waxes.

Use may also be made of the waxes obtained by hydrogenation of castor oil esterified with cetyl alcohol which are sold under the names of Phytowax Castor 16L64® and 22L73® by Sophim. Such waxes are described in the application FR-A-2 792 190.

Use may be made of a wax referred to as a "tacky wax", that is to say having a tack of greater than or equal to 0.1 N·s and a hardness of less than or equal to 3.5 MPa.

Use may be made, as tacky wax, of a $C_{20}$-$C_{40}$ alkyl (hydroxystearyloxy)stearate (the alkyl group comprising from 20 to 40 carbon atoms), alone or as a mixture.

Such a wax is sold in particular under the names "Kester Wax K 82 P®", "Hydroxypolyester K 82 P®" and "Kester Wax K 80 P®" by Koster Keunen.

The adhesive can comprise, can indeed even be composed of, a mixture of the compounds A/ to G/ defined above.

The liquefiable adhesive is preferably chosen from ethylene/vinyl acetate copolymers, optionally with the addition of paraffin or of a PDMS oil.

The total weight of composition P within the elements according to the invention is, for example, comprised between 5 and 300 mg, better still 10 and 100 mg. The composition P is preferably solid at 20° C., that is to say that it does not flow under the effect of gravity at this temperature.

The composition P, when it is not composed solely of the liquefiable adhesive, can comprise an active principle, a wax, an oil, a surfactant, for example a silicone surfactant, or one or more pigments and/or dyes intended, for example, to opacify the composition and/or to give it the desired color, for example a black iron oxide. The liquefiable adhesive preferably exhibits a threading ($d_{max}$) of greater than or equal to 5 mm, for example obtained at a temperature of greater than 40° C. The $d_{max}$ threading nature is defined in the French patent application filed under No. 06 53468, the passage from page 3, line 11 to page 4, line 14, of which is incorporated by reference.

The content by weight of liquefiable adhesive in the composition P is, for example, comprised between 1 and 100%, preferably greater than 50%, better still approximately 80%.

The content of coloring agents, in particular of pigment(s), for example black iron oxide, in the composition P is, for example, comprised between 1 and 10%.

The adhesive used is preferably reversible, that is to say that, on being heated again or brought into contact with a suitable solvent, it liquefies. In an alternative form, the composition P comprises ingredients which make possible a permanent adhesive bonding.

It is possible in particular to choose the additional compounds from those appearing in the passages "waxes", "emulsifying system", "water-soluble gelling agent", "oils", "film-forming polymer", "coloring material", "fillers" and "cosmetic active principles" of the French patent application filed under No. 06 53468, these passages being incorporated by reference.

Use

Figure 7:
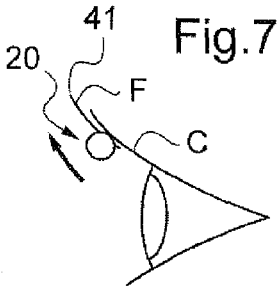
FIGS. 7A to 7D are photographs of examples of the adhesive bonding of fibers to a test specimen of false eyelashes.

In order to use the device according to the invention, the user, once the melting point for the composition P has been reached, brings the element into contact with the eyelashes C to be elongated, with the free end 41 of the fibers F directed outwards, as illustrated in FIG. 7.

The user brings the eyelashes into contact with the composition P and moves the heating tip upwards and outwards. Surprisingly, the fibers F become stuck easily and rapidly to the eyelashes and, in addition, in a very attractive way, at illustrated in FIG. 8.

Prior to the application of the fibers, the eyelashes or other keratinous fibers intended to receive them can be coated with a composition targeted at facilitating the removal of makeup or, on the other hand, improving the attachment of the fibers.

EXAMPLES

Example 1

The adhesive composition described below is used in combination with fibers composed of head hair, with a length of the order of 15 mm, carried by a ribbed thermoplastic support, such as that represented in FIG. 3.

| | % by weight | Supplier | Trade name |
|---|---|---|---|
| Black iron oxide | 4 | Sun | Sunpuro Black Iron Oxide |
| Ethylene/VA copolymer | 81 | National Starch | Cool Bind 34-1300 ® |
| Polydimethylsiloxane carrying triglycerol groups and $C_{12}$ alkyl groups | 15 | Shin-Etsu | KF-6105 |

Use is made of the application device 10 described above with reference to FIG. 1.

Application to the eyelashes takes place under hot conditions, when the composition P is molten, at approximately 65° C., by combing the eyelashes with element 20 charged with adhesive and fibers F.

The make up result obtained after application to the external eyelashes of the eye is that represented in FIG. 8.

Example 2

The following adhesives were tested, the application protocol of Example 1 being reproduced, on a test specimen of false eyelashes:

a) $C_{18}$-$C_{38}$ fatty alkyl (hydroxystearoyloxy)stearate (Kester Wax K 82 P)

b) Vinyl acetate/allyl stearate (65/35) copolymer (Mexomere PQ)

c) Poly(isobornyl methacrylate-co-isobornyl acrylate-co-isobutyl acrylate-co-acrylic acid) (Mexomere PAS)

d) Adhesive composition of Example 1

From these tests, an E/VA copolymer adhesive provides the best results by making it possible to position the fibers at the free end of the eyelashes (end-to-end/in the alignment).

Figure 7A:
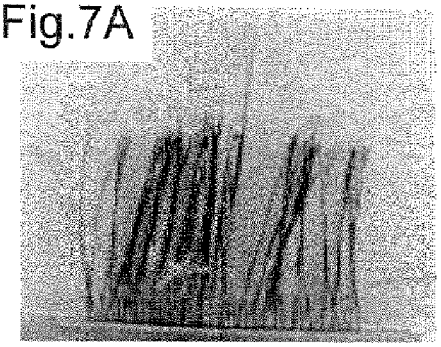
Figure 7B:
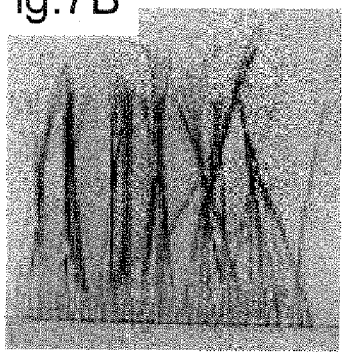
Figure 7C:
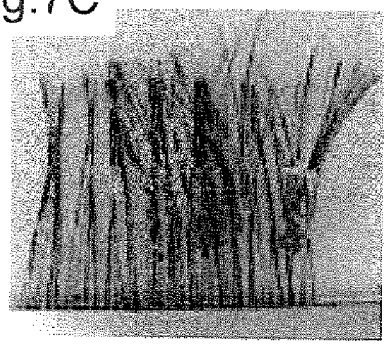

FIG. 7A corresponds to the result obtained with the adhesive a), 7B to the adhesive b) and 7C to the adhesive c) with, in the three cases, as a result, the fibers adhesively bonded to the test specimen at the base.

Figure 7D:
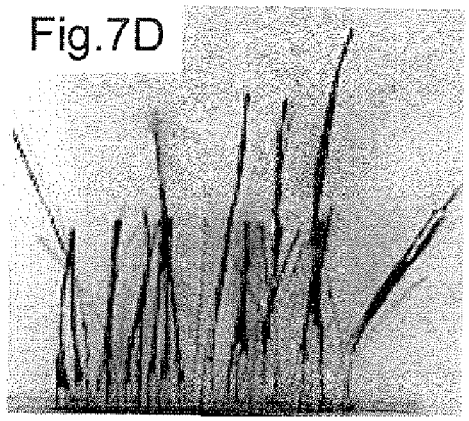

With the adhesive d) corresponding to FIG. 7D, the fibers are adhesively bonded to the tips of the eyelashes of the test specimen.

Other Alternative Forms

Although an adhesive which can liquefy under hot conditions has more particularly been described, an adhesive composition which can liquefy by introduction of solvent, for example water or alcohol, can be used.

For example, use may be made of a polymer which is soluble in ethanol. For example, use is made of a formulation of Ultrahold Strong (BASF) at 20% in ethanol, which is deposited on the support, care being taken to hold the fibers thereon and that the amount applied is sufficient to create a thickness of polymer amply covering the fibers. After drying, the fibers are released. They are adhesively bonded to the support.

At the moment of use, a small amount of ethanol is applied, which will soften the polymer. The support is then drawn close to the eyelashes and, by an outwards movement, the fibers are adhesively bonded to the eyelashes.

The eyelashes or other keratinous fibers can be coated with a first compound and the element can comprise a second liquefiable compound capable of reacting with the first to form an adhesive capable of holding the fibers on the eyelashes. For example, the example with use of ethanol above is taken up again and ethanol is applied to the eyelashes.

The invention is very particularly suitable for the eyelashes but also applies to the treatment of the hair, for corrective purposes, for example for correcting a haircut with areas cut too short, or for the purposes of embellishment, either for lengthening the hair or for densifying it or for obtaining novel color effects. The invention is also suitable for the treatment of the eyebrows.

The expression "comprising one" is synonymous with "comprising at least one", unless otherwise specified.

The expression "comprised between" means limits included.

The invention claimed is:

1. An element for the application of fibers to human eyelashes to elongate the eyelashes and/or introduce fibers between the eyelashes, comprising fibers held together in a predefined way by a liquefiable adhesive in the solid form, the liquefying of the adhesive on application making it possible for at least a part of the fibers to separate from the element, wherein the adhesive comprises a copolymer of ethylene and of vinyl acetate that comprises more than 25% by weight of vinyl acetate, with respect to a total weight of the copolymer.

2. The element according to claim 1, wherein the liquefiable adhesive is a hot-melt adhesive.

3. The element according to claim 1, wherein the fibers are colored and/or made up prior to application to the eyelashes.

4. The element according to claim 1, wherein the length of the fibers is greater than or equal to 4 mm.

5. The element according to claim 1, wherein the adhesive is chosen from a mixture of the ethylene/vinyl acetate copolymer and of paraffin.

6. The element according to claim 1, wherein the adhesive comprises a fatty substance chosen from hydrocarbon oils or silicone oils.

7. The element according claim 1, wherein the number of fibers ranges from 1 to 300.

8. The element according to claim 1, wherein the adhesive of the element forms a self-supporting sheet.

9. The element according to claim 1, wherein the adhesive of the element is carried by a support.

10. The element according to claim 9, wherein the fibers are positioned individually on the support.

11. The element according to claim 9, wherein the fibers are grouped together in bundles on the support.

12. A kit, comprising:

an element as defined in claim 1; and an application device comprising a liquefying region on which at least a part of the element can be fitted.

13. The kit according to claim 12, wherein the liquefying region is disposed on a heating means and the adhesive is a hot-melt adhesive.

14. A cosmetic treatment method, comprising:

contacting eyelashes with fibers of an element as defined in claim 1, wherein the adhesive is liquefied; and adhering at least a portion of the fibers to the eyelashes.

15. The method according to claim 14, further comprising modifying at least one characteristic of the fibers before, during, or after adhering.

16. The method according to claim 14, wherein the adhesive is not in contact with the eyelid during the contacting of the eyelashes with the element.

17. An element for the application of fibers to human eyelashes to elongate the eyelashes and introduce fibers between the eyelashes, comprising:

a support; and fibers positioned in a predefined way and bonded to the support by a liquefiable adhesive, wherein the adhesive comprises a copolymer of ethylene and of vinyl acetate and the copolymer comprises more than 25% by weight of vinyl acetate, with respect to a total weight of the copolymer.

18. The element according to claim 17, wherein the support is ribbed.

* * * * *